US006543439B1

(12) United States Patent
Köllner

(10) Patent No.: US 6,543,439 B1
(45) Date of Patent: Apr. 8, 2003

(54) COOKING AREA COVER PANEL TO BE APPLIED SEPARATELY FOR A COOK-TOP WITH SPACER FEET

(75) Inventor: Hanns-Joachim Köllner, Düsseldorf (DE)

(73) Assignee: Wenko-Wenselaar GmbH & Co. KG, Hilden (DE)

( * ) Notice: Subject to any disclaimer, the term of this patent is extended or adjusted under 35 U.S.C. 154(b) by 0 days.

(21) Appl. No.: 09/665,561

(22) Filed: Sep. 18, 2000

(30) Foreign Application Priority Data

Feb. 10, 2000 (DE) ..... 200 02 429 U
Feb. 16, 2000 (DE) ..... 200 02 796 U
Feb. 22, 2000 (DE) ..... 200 02 968 U

(51) Int. Cl.[7] ..... F24C 15/10
(52) U.S. Cl. ..... 126/221; 269/302.1; 248/363
(58) Field of Search ..... 126/211, 215, 126/216, 220, 221, 39 B; 108/156; 269/302.1; 248/363; 428/99

(56) References Cited

U.S. PATENT DOCUMENTS 4,116,426 A * 9/1978 Kessler ..... 269/307
4,346,875 A * 8/1982 Spencer et al. ..... 248/363
6,279,567 B1 * 8/2001 Taplan ..... 126/215

FOREIGN PATENT DOCUMENTS

| | | | |
|---|---|---|---|
| AT | 279753 | 3/1970 | |
| DE | 2930456 A1 * | 4/1980 | ..... 126/39 B |
| DE | 8125655 | 12/1981 | |
| DE | 9202362 | 6/1992 | |
| DE | 19509739 | 11/1996 | |
| DE | 29813303 | 11/1998 | |
| DE | 29913067 U1 * | 1/2000 | |
| GB | 2316480 A * | 2/1998 | |

* cited by examiner

*Primary Examiner*—Sara Clarke
(74) *Attorney, Agent, or Firm*—Crowell & Moring LLP

(57) ABSTRACT

A cooking area cover panel to be applied separately for a cooking area is made of a hard material and comprises a plurality of individual partial covering panels having an underside and a top side and spacer feet provided with connecting means for selectively mounting on the cooking area cover panel. The spacer feet are mountable to the underside of the cooking area cover panel in a ready-to-use condition, wherein the spacer feet are separate from the cooking area cover panel in a disassembled condition of the cooking area cover panel.

1 Claim, 4 Drawing Sheets

COOKING AREA COVER PANEL TO BE APPLIED SEPARATELY FOR A COOK-TOP WITH SPACER FEET

FIELD OF THE INVENTION

The present invention relates to a cooking area cover panel to be applied separately. More particularly, the invention relates to a cooking area cover panel whose outside dimensions correspond approximately to the dimensions of the cooking area. Preferably this cooking area cover panel is composed of several, in particular of exactly two individual partial cover panels to be applied separately.

BACKGROUND OF THE INVENTION

The known cooking area cover panel is intended for use with a cooking area on which this invention is based (German Utility Model 298 13 303 U1) for a glass ceramic cooking area. As a panel to be applied separately, it or each of the partial cover panels has several spacer feet, in particular at least four spacer feet designed on the underside or applied to the underside. The spacer feet hold the cooking area cover panel itself at a slight distance from the cooking zones of the glass ceramic cooking area, so that normally there is no overheating of the cooking area cover panel.

The known cooking area cover panel consisting of two individual partial cover panels to be applied separately is from the very beginning provided in a ready-to-use condition with spacer feet designed on or applied to the underside. When equipped with taller spacer feet accordingly, this can of course also be used with a cooking area with electric cooking plates inserted individually or with other types of cooking areas, in particular with gas cooking areas. The taller the spacer feet, the greater the amount of space needed for the cooking area cover panel in packaging, shipping and storing.

The teaching according to the present invention is based on the problem of improving the known cooking area cover panel with regard to universal applicability in the optimal way.

SUMMARY OF THE INVENTION

The problem posed above is solved by the cooking area cover panel to be applied separately for a cooking area. The cooking area cover panel is made of a hard material and comprise a plurality of individual partial covering panels having an underside and a top side and spacer feet provided with connecting means for selectively mounting on the cooking area cover panel. The spacer feet are mountable to the underside of the cooking area cover panel in a ready-to-use condition, wherein the spacer feet are separate from the cooking area cover panel in a disassembled condition of the cooking area cover panel.

According to this invention, the spacer feet are first supplied separately from the cooking area cover panel. They may be included in the shipment or purchased separately by the customer. At any rate, the spacer feet are separate from the cooking area cover panel at the time of purchase or delivery of the cooking area cover panel. However, they are provided with-means for attaching them subsequently to the cooking area cover panel. Thus, the customer can attach the spacer feet to convert the smooth cooking area cover panel to the ready-to-use condition with the spacer feet mounted on the underside. Even though the attachment in this connection is permanent, it must not be non-releasable. A temporary detachment may be recommendable especially for cleaning purposes.

The inventive teaching has firstly significant advantages with respect to the packaging and shipping of the cooking area cover plate.

However, this teaching has also considerable advantages with regard to universal applicability of a cooking area cover panel. For example, several sets of spacer feet of different heights could be packaged with a cooking area cover panel (optionally consisting of several partial cover panels) in the as-delivered or purchased state. Then, depending on the cooking area available in each specific case, the customer can select the spacer feet with the proper height and attach them to the cooking area cover panel. The other spacer feet that are not needed can be saved or discarded. This permits universal applicability of the cooking area cover panel, which can be used for a glass ceramic cooking area or for a metal cooking area with electric cooking plates or even for a gas cooking area using gas burners, depending on the customer's wishes.

Possible alternatives also consist of designing the spacer feet for the maximum installed height so they can be cut to the desired height, or they may be designed as multi-part plug-on or stick-on elements. An especially interesting alternative is to design the connecting means as suction cups. It is especially advisable here for the spacer foot to be detachable from the suction cup and therefore to have a catch opening for a catch nub on the suction cup.

All the alternatives have in common the fact that it is the customer or the user of the cooking area cover panel who puts it in the ready-to-use condition by attaching the proper spacer feet for his/her cooking area to the cooking area cover panel.

An independent alternative consists of providing separate elevation feet for the cooking area cover panel, so that the elevation feet can be attached to the cooking area at the desired locations, and the desired installation height of the cooking area cover panel on the cooking area can be achieved. This can also be achieved in principle with a cooking area cover panel that is smooth on the underside or with partial cover panels that are smooth on the underside. However, this is especially expedient to implement in combination with a cooking area cover panel which may optionally also be provided permanently with small spacer feet from the beginning. In the latter case, either the elevation feet may serve independently as support, or the spacer feet may be placed on the elevation feet.

In implementing suction cups as the connecting means, these suction cups may also be used as (low) spacer feet on the side working panel if the spacer feet which then function as elevation feet are designed to be easily removed from the suction cups.

Additional embodiments and refinements of the present invention are the object of the additional subordinate claims.

BRIEF DESCRIPTION OF THE DRAWINGS

In the following, the invention will be explained in more detail with the aid of the drawing illustrating only one embodiment. The drawings show.

DETAILED DESCRIPTION OF THE INVENTION

Figure 1:
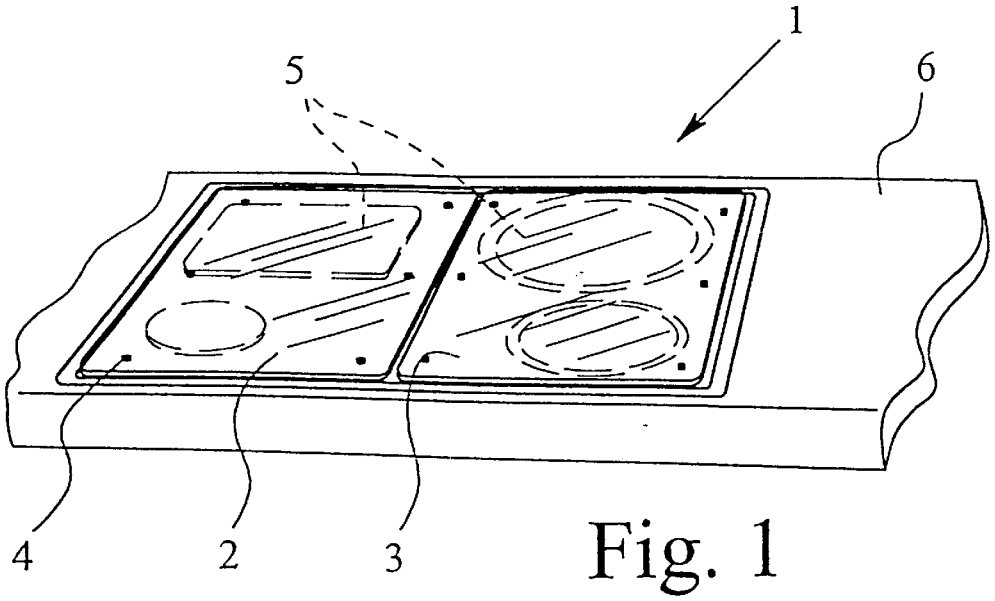
FIG. 1 a first embodiment with two partial cooking area cover panels of approximately the same size for a glass ceramic cooking area.

The embodiment illustrated in FIG. 1 shows first a cooking area cover panel for a cooking area 1 which is installed in a kitchen working panel 6 in a known way. A cooking area cover panel 2, 3 whose dimensions correspond to the dimensions of cooking area 1 is provided on the cooking area 1. The cooking area cover panel 2, 3 is composed of multiple partial cover panels 2, 3. The embodiment illustrated here, which is preferred, has two single partial cover panels 2, 3 whose outside dimensions supplement each other to form the dimensions of the cooking area 1. With a wider cooking area 1 with a width of 90 cm, for example, three partial cover panels 2, 3 may also be arranged side by side. A larger number of partial cover panels 2, 3 is also possible in principle.

A glass ceramic cooking area 1 is illustrated here, but this is not to be understood in a restrictive sense. The cook tops may also be metal cooking areas with individually inserted electric cooking plates or gas cooking areas with individual gas burners, for example. The teaching according to the present invention also relates to a particular design of a cooking area cover panel such that it can be used for different cooking areas 1.

The advantages of multiple partial cover panels 2, 3 as parts of an overall cooking area cover panel 2, 3 are explained in the documents that form the basis of German Utility Model 298 13 303 U1, the prior art document mentioned above. Reference is herewith made to that utility model.

The embodiment illustrated in FIG. 1 shows two individual partial cover panels 2, 3 which have the same outside dimensions. These two partial cover panels 2, 3 can be stacked especially well. The embodiment illustrated in FIG. 2 has an alternative with two partial cover panels 2, 3 which do not have the same outside dimensions.

Figure 3:
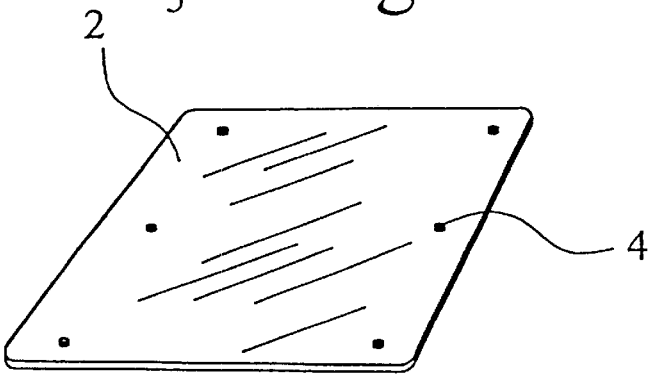
FIG. 3 an enlarged perspective view of a partial cooking area cover panel.

The embodiments illustrated here show, as seen especially well in FIG. 3, that the partial cover panels 2, 3 forming the cooking area cover panel 2, 3 are provided with spacer feet 4 mounted on the underside in the ready-to-use condition. FIG. 3 shows a total of six such spacer feet 4. The teaching of the present invention concerns the arrangement and design of these spacer feet 4.

Figure 2:
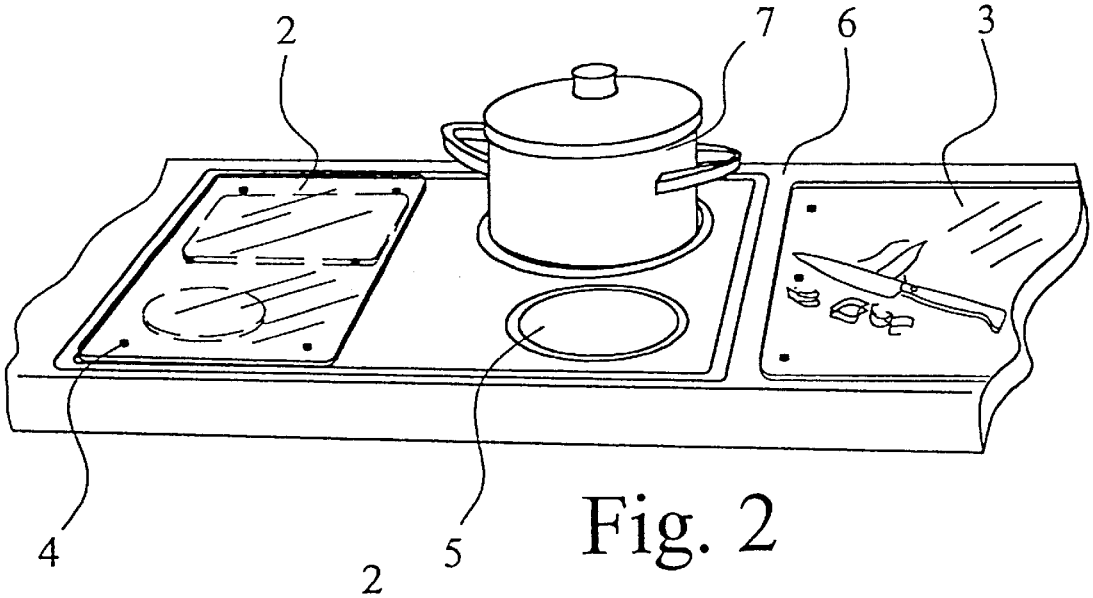
FIG. 2 another embodiment with partial cooking area cover panels of different sizes.

The figures also show cooking zones 5 of the glass ceramic cooking area 1 shown here, the working panel 6 and a cooking pot 7 placed on a cooking zone 5 in FIG. 2 as an example. FIG. 2 shows especially well how practically the partial cover panel 3 can be used on the working panel 6, while the partial cover panel 2 can serve as a nearby working surface on the cooking area 1 next to the cooking pot 7.

It is especially advantageous if the partial cover panels 2, 3 are made of fracture-proof glass. It may be clear or provided with a decoration. Partial cover panels 2, 3 made of hard, fracture-proof and scratch-proof glass meet all the requirements regarding ease of handling and hygiene in the kitchen. They are suitable for setting down hot pots and pans, and their scratch-proof and pore-free surface prevents bacteria from collecting and prevents odors from developing. The partial cover panels 2, 3 can be cleaned well and form an excellent substrate as a working panel.

Materials other than fracture-resistant glass are fundamentally also possible for producing corresponding partial cover panels 2, 3 for a cooking area 1. In particular, heat-resistant laminates, molded plastics or glass ceramic may be used.

The spacer feet 4 are necessary for the cooking area cover panel 2, 3 so that the cooking area cover panel 2, 3 or its partial cover panels 2, 3 do not come in contact with cooking area 1 or the corresponding electric cooking plates, gas burners and/or pot carriers, which can be very hot. The installed height of the spacer feet varies for the different cooking areas 1 (e.g., 25 mm for electric burners, 5 mm for glass ceramic cooking area, 40 mm for gas burners). The present invention takes this into account in that the spacer feet 4 are still separate from the cooking area cover panel 2, 3 in the as-delivered or purchased condition. However, the spacer feet 4 are provided with connecting means 8 for later mounting on the cooking area cover panel 2, 3.

In particular, the spacer feet 4 can be made of a plastic that has the required heat resistance and which can be mounted well on the underside of the cooking area cover panel 2, 3. It is especially advisable for the spacer feet 4 to be made entirely or partially of a plastic with a surface having a high coefficient of friction, in particular a thermoplastic elastomer. As an alternative natural rubber is possible.

In particular, FIGS. 4*a*, 5*a*, 5*b*, and 5*c* and 6 show connecting means 8 on the spacer feet 4 which are designed as self-stick layers. The protective film is pulled away from the self-stick layer and the spacer foot 4 is pressed on the underside of the cooking area cover panel 2, 3 and thus permanently attached there. In particular, reference is made in this regard to the applicants utility model patent application that was filed at the same time and relates to the matter of applying a protective film to the underside of the cooking area cover panel 2, 3.

Figure 4A:
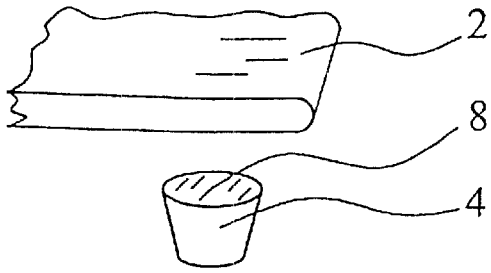
FIG. 4*a* a first variant of a spacer foot provided with connecting means for a cooling area cover panel according to this invention.
Figure 4B:
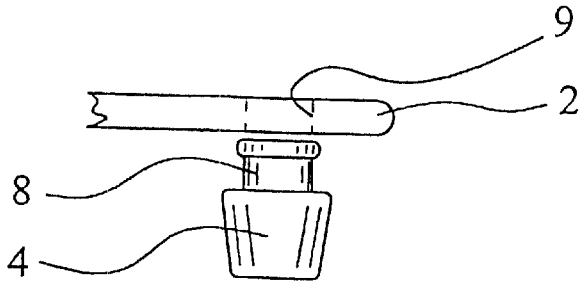
FIG. 4*b* a second variant of a spacer foot provided with connecting means for a cooling area cover panel according to this invention.

FIG. 4*b* shows an alternative which is characterized in that the connecting means 8 is designed as catch nubs on the spacer foot 4. A measure must be provided on the cooking area cover panel 2, 3 such that it has a corresponding catch opening 9 at the intended fastening spot for the spacer foot 4. By pressing the catch nub into catch opening 9, it is possible to achieve a permanent mounting of the spacer foot 4 on the cooking area cover panel 2, 3. This is illustrated in FIG. 4*b* with cooking area cover panel 2 and its catch opening 9, only a detail of which is shown.

Figure 4C:
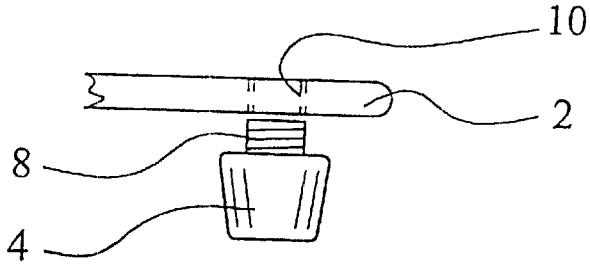
FIG. 4*c* a third variant of a spacer foot provided with connecting means for a cooling area cover panel according to this invention.

An alternative also consists of providing the connecting means 8 as a threaded pin, optionally with a lock nut, and providing the cooking area cover panel 2, 3 with a corresponding threaded socket 10 or a through-hole. FIG. 4*c* shows this variant. If the cooking area cover panel 2, 3 is made of fracture-proof glass, then a through-hole may instead be implemented as a threaded socket which is difficult to provide in it.

Figure 4D:
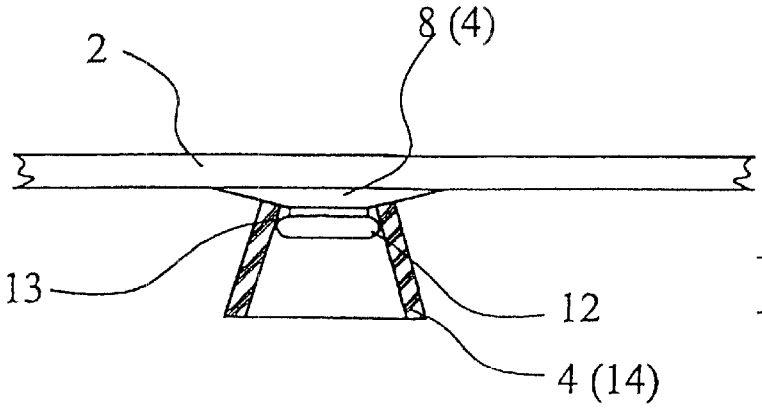
FIG. 4*d* a fourth variant of a spacer foot provided with connecting means for a cooling area cover panel according to this invention.

FIG. 4*d* illustrates an embodiment which is characterized in that the connecting means 8 are designed as suction cups 11. This also provides for the spacer foot 4 to be detachable from the suction cup 11 and therefore it has a catch opening 12 for a catch nub 13 of the suction cup 11. The standing security is especially good here due to the fact that the spacer foot 4 is designed as an inverted cup shape or as a truncated conical shape. This alternative is especially advantageous with different cooking areas 1 with differently arranged and designed cooking zones 5. The spacer feet 4 are simply attached to the cooking area 1 at the locations where this is an expedient arrangement with regard to the arrangement of the cooking zones 5. The suction cups 11 are then snapped onto the spacer feet 4. The suction cups 11 are moistened and then the corresponding partial cover panel 2, 3 is pressed onto the respective suction cups 11. Thus, the spacer feet 4 are automatically positioned in the correct locations.

If working with comparatively tall spacer feet 4 on working panel 6 which has a smaller height, the spacer feet 4 can easily be detached from the remaining suction cups 11 on the partial cover panel 2, 3, given a suitable design, and the suction cups 11 can then be used even with their catch nubs 13 as lower spacer feet on the working panel 6. The "actual" spacer feet 4 then have the function of the elevation feet 14 to be explained below.

Figure 5A:
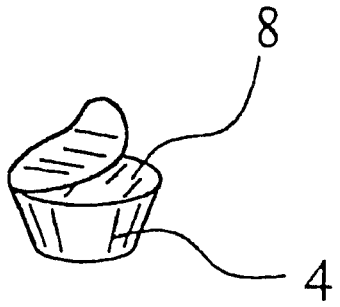
FIG. 5*a* a first sample spacer foot of a first height for a cooking area cover panel according to this invention.
Figure 5B:
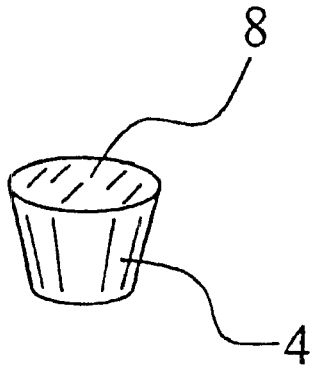
FIG. 5*b* a second sample spacer foot of a second height for a cooking area cover panel according to this invention.
Figure 5C:
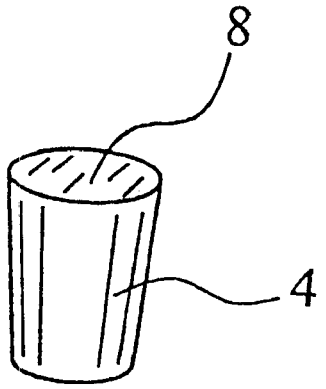
FIG. 5*c* a third sample spacer foot of a third height for a cooking area cover panel according to this invention.

FIGS. 5*a*, 5*b* and 5*c* show that for universal applicability for all types of cooking areas 1, a cooking area cover panel 2, 3 can be equipped with multiple sets of spacer feet 4 of different heights even in the as-delivered or purchased condition. As an alternative, it is of course also possible for the customer to order the proper set of spacer feet 4 for the cooking are cover panel 2, 3 at the same time. If multiple sets of spacer feet 4 of different heights are provided for the different use cases from the beginning, then the customer can simply select the proper set of spacer feet 4 and attach them to the cooking area cover panel 2, 3.

Figure 6:
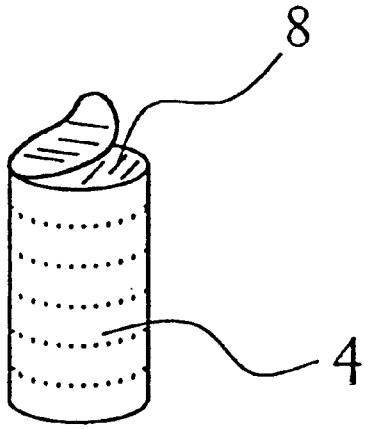
FIG. 6 a spacer foot that can be cut to different heights for another embodiment of a cooking area cover panel according to this invention.

FIG. 6 shows an alternative to the solution described above with multiple sets of spacer feet 4 of different heights, consisting of designing the spacer feet 4 with a height corresponding to the maximum possible installation height. The spacer feet 4 may then be cut to the desired height in the ready-to-use condition. One would then have, for example, the maximum installed height for a gas cooking area, but the spacer feet 4 can be cut to the minimum installed height for a glass ceramic cooking area if the respective customer has a glass ceramic cooking area. In the embodiment illustrated in FIG. 6 and discussed above, it is advisable for the spacer feet 4 to have cutting marks corresponding to the conventional installed heights. These may simply be visual marks, but they are preferably surface indentations or cuts that also serve as a guide for a suitable tool, so that a precise cut can be made.

Another alternative which is not illustrated in this drawing also consists of the fact that the spacer feet 4 are designed as multi-part plug-on or stick-on elements with a small individual height. This is opposite to the embodiment according to FIG. 6. A sufficiently large number of plug-on or stick-on elements, preferably similar, are provided prepackaged with the cooking area cover panel 2, 3, so that the required number of plug-on or stick-on elements can be assembled to achieve the required installed height of the spacer feet 4 for the given application.

Figure 7:
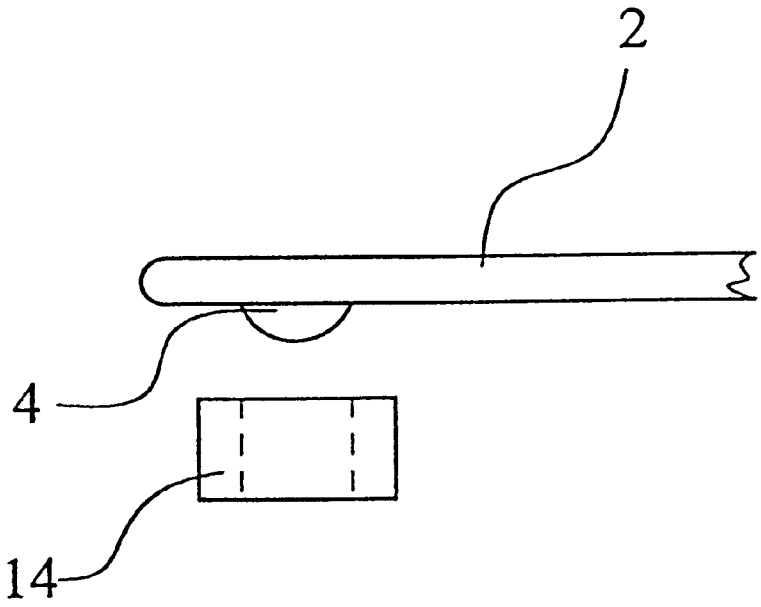
FIG. 7 another embodiment of a cooking area cover panel according to this invention with a spacer foot and an elevation foot, shown in excerpts.

In practice, it has been found that very high spacer feet 4 such as those which may be necessary for a gas cooking area 1, for example, may be uncritical for covering the cooking area 1 per se, but they are not practical in handling if the cooking area cover panel 2, 3 or the corresponding partial cover panels 2, 3 are used next to the cooking area 1 on the kitchen working panel 6. It is self-evident that a greater height of the spacer feet 4 contributes to their instability. The alternative of this invention as illustrated in FIG. 7 is to provide separate elevation feet 14 for the cooking area cover panel 2, 3, in which case the elevation feet 14 can be placed on the cooking area 1 and the desired installed height of the cooking area cover panel 2, 3 in the cooking area 1 achieved by means of these elevation feet 14. The elevation feet 14 of this alternative need not necessarily have spacer feet 4 on the cooking area cover panel 2, 3. However, they are especially expedient in combination with spacer feet 4 of a small height on the cooking area cover panel 2, 3. Thus, although the required installed height for the cooking area 1 is achieved, the (low) spacer feet 4 on the cooking area cover panel 2, 3 nevertheless allow secure and stable working on the working panel 6 at the side.

In this case, because the spacer feet 4 have the lowest possible height, namely the height for a glass ceramic cooking area 1, they may be permanently attached to the cooking area cover panel 2, 3 from the very beginning, as is already known in the state of the art, which forms the starting point of the present invention. Only the elevation feet 14 are then purchased separately by the customer or are packaged with the cooking area cover panel 2, 3 in the as-delivered or purchased condition.

The elevation feet 14, one of which is indicated in FIG. 7, may be placed loosely on the cooking area 1. This will more likely be the standard case. However, the elevation feet 14 may be attached permanently to the cooking area 1, in particular by gluing them. Of course, this must be done with a connecting means suitable to tolerate the heating of the cooking area 1.

Finally, FIG. 7 shows that in the embodiment illustrated here, the elevation feet (14) has a central opening or recess for mounting and lateral alignment of the spacer feet 4. This may but need not be implemented in this way. The advantage of this arrangement is that the cooking area cover panel 2, 3 or the corresponding partial cover panels 2, 3 are aligned and secured at the sides and consequently cannot slip.

Moreover, in principle the same considerations apply to the elevation feet 14 as the spacer feet 4, in particular with regard to multiple sets of elevation feet 14, etc. of different heights.

FIG. 4*d* shows that in the embodiment illustrated there, the connecting means 8 also have the function of a low spacer foot, and the spacer foot 4 accordingly forms the elevation foot in the terminology used previously.

What is claimed is:

1. A kit forming a cooking area cover panel to be applied to a cooking area, wherein the cooking area cover panel is made of a solid material; comprising:

a plurality of individual partial covering panels having an underside and a top side; and spacer feet provided with connecting means for selectively mounting on said plurality of individual partial covering panels comprising the cooking area cover panel, the spacer feet being mountable to the underside of the cooking area cover panel in a ready-to-use condition, wherein the spacer feet are separate from the cooking area cover panel in a disassembled condition of the cooking area cover panel, wherein the connecting means are configured as suction cups, and wherein each spacer foot can be detached from the suction cup and has a catch opening for a catch nub of the suction cup.

* * * * *